United States Patent [19]

Lopez et al.

[11] 4,356,154

[45] Oct. 26, 1982

[54] URANIUM EXTRACTION COEFFICIENT CONTROL IN THE PROCESS OF URANIUM EXTRACTION FROM PHOSPHORIC ACID

[75] Inventors: Jose G. Lopez, Lakeland; Kenneth W. Gould, Winter Haven, both of Fla.

[73] Assignee: Wyoming Mineral Corporation, Lakewood, Colo.

[21] Appl. No.: 114,465

[22] Filed: Jan. 23, 1980

[51] Int. Cl.[3] ..... C01G 43/00

[52] U.S. Cl. ..... 423/10; 423/8

[58] Field of Search ..... 423/10, 8

[56] References Cited

U.S. PATENT DOCUMENTS

| | | | |
|---|---|---|---|
| 3,268,288 | 8/1966 | Goren | 423/18 |
| 3,711,591 | 1/1973 | Hurst et al. | 423/10 |
| 3,836,476 | 9/1974 | Baldwin et al. | 423/10 |
| 3,966,873 | 6/1976 | Elikan | 423/10 |
| 4,258,013 | 3/1981 | Pyrih et al. | 423/15 |
| 4,277,454 | 7/1981 | Long et al. | 423/10 |

OTHER PUBLICATIONS

Clegg et al., "Uranium Ore Processing", (Atoms for Peace Series) Addison—Wesley Publishing Co., Inc., pp. 375 & 377 (1958) Reading, Mass.

*Primary Examiner*—Edward A. Miller
*Attorney, Agent, or Firm*—D. P. Cillo

[57] ABSTRACT

Controlling the uranium extraction coefficient in uranium extraction processes involving wet process phosphoric acid feed is accomplished by monitoring the oxidation potential of the raffinate acid stream exiting the extractor, and maintaining the oxidation potential of the raffinate at a value above 350 mV.

7 Claims, 14 Drawing Figures

URANIUM EXTRACTION COEFFICIENT CONTROL IN THE PROCESS OF URANIUM EXTRACTION FROM PHOSPHORIC ACID

BACKGROUND OF THE INVENTION

Uranium and other metal values can be recovered from commercial grade, wet process phosphoric acid by liquid-liquid extraction processes. In one of these processes, phosphoric acid feed solution is first oxidized, before extraction, to ensure that the uranium is in the +6 oxidation state (uranyl ion $UO_2^{+2}$). Hurst et al., in U.S. Pat. No. 3,711,591, taught oxidizing phosphoric acid, prior to extraction, with sodium chlorate, or by bubbling air through the phosphoric acid at 60° to 70° C.

The use of air alone, however, as in Hurst et al., even in large quantities, generally gives an extremely slow oxidation rate. The use of sodium chlorate in excessive amounts, adds to costs, and can cause corrosion in process equipment. Release of chlorine or similar type gases could cause health hazards and could result in the attack of rubber liners in process pipes and evaporators. This might require the addition of some type of mild reducing or oxidant deactivation agent to control a chlorine or similar type chemical release. Use of the chlorate type oxidant in inadequate amounts, may leave some uranium in the +4 state, subject to ineffective extraction in a di(2-ethylhexyl) phosphoric acid (D2EHPA)trioctylphosphine oxide (TOPO) process. What is needed is a method for correlating a problem situation in the system with the extent of oxidation of the uranium in the phosphoric acid as it leaves the extractor, in order to maximize uranium extraction through control of the oxidation potential.

SUMMARY OF THE INVENTION

The above needs are met by the following method of recovering uranium from wet process phosphoric acid involving controlling the uranium extraction coefficient in the uranium extraction processes:

(1) continuously contacting the commercial wet process phosphoric acid feed solution, which contains $U^{+4}$ and $Fe^{+2}$ ions and has an oxidation potential of below 350 mV. (millivolts), with an oxidant, in the first cycle of the process, in an amount effective to raise the oxidation potential of the phosphoric acid solution to a value above 350 mV. at or prior to extraction, and convert $U^{+4}$ and $Fe^{+2}$ ions to $U^{+6}$ and $Fe^{+3}$ ions respectively, in an equilibrium reaction. Contacting the oxidized phosphoric acid solution in an extraction means with a uranium extraction solvent composition, such as D2EHPA-TOPO in a suitable diluent, to provide a pregnant, uranium rich solvent stream characterized as having a uranium extraction coefficient value of over about 1.0, and a raffinate acid stream containing iron ions;

(2) reductively stripping uranium from the pregnant, uranium rich solvent stream in a stripping means, to provide a uranium rich product stream, and a uranium extraction solvent composition stream which contains minor amounts of iron ions in the form of $Fe^{+2}$;

(3) feeding the uranium extraction solvent composition stream back into the extraction means, to contact oxidized phosphoric acid solution containing $U^{+6}$ and $Fe^{+3}$ ions, to provide additional uranium rich solvent and iron ion containing raffinate, where the $Fe^{+2}$ in the extraction solvent composition can affect the valence of the $U^{+6}$ in the uranium rich solvent stream, and cause the uranium extraction coefficient of the uranium rich solvent stream to drop;

(4) measuring the oxidation potential of the raffinate acid stream with a suitable measuring means; and (5) maintaining the oxidation potential of the raffinate acid stream at a value above 350 mV., when the oxidation potential of the raffinate acid stream drops to a value of below 350 mV., with a corresponding drop in the value of uranium extraction coefficient of the uranium rich solvent stream, possibly due to a high built-up concentration of $Fe^{+2}$ in the raffinate acid stream.

Thus, by monitoring the oxidation potential of the raffinate acid stream as it leaves the extractor, it is possible to recognize when the $U^{+4}$ to $U^{+6}$ equilibrium in the extractor has been upset and the uranium extraction coefficient in the uranium rich solvent stream has been dropped to a value below 1.0, for a DE2HPA-TOPO system.

BRIEF DESCRIPTION OF THE DRAWINGS

For a better description of the invention, reference may be made to the preferred embodiments exemplary of the invention, shown in the accompanying drawings, in which.

DESCRIPTION OF THE PREFERRED EMBODIMENTS

The wet process phosphoric acid solution formed from uncalcined phosphate rocks generally contains about 600 grams/liter of $H_3PO_4$, about 0.2 gram/liter of uranium, about 1 gram/liter of calcium, about 9 grams/liter of iron, about 28 grams/liter of sulfate and about 30 grams/liter of fluorine. The phosphoric acid solution also contains varying amounts of arsenic, magnesium, aluminum, and humic acid impurities.

In the reductive strip process of recovering uranium from the wet process phosphoric acid by using D2EHPA-TOPO uranium extraction solvent, the uranium present must be oxidized from the +4 to the +6 oxidation state (uranyl ion $UO_2^{+2}$). During oxidation, by the addition of any suitable oxidant, the iron present is also oxidized from the +2 to the +3 state.

Figure 1:
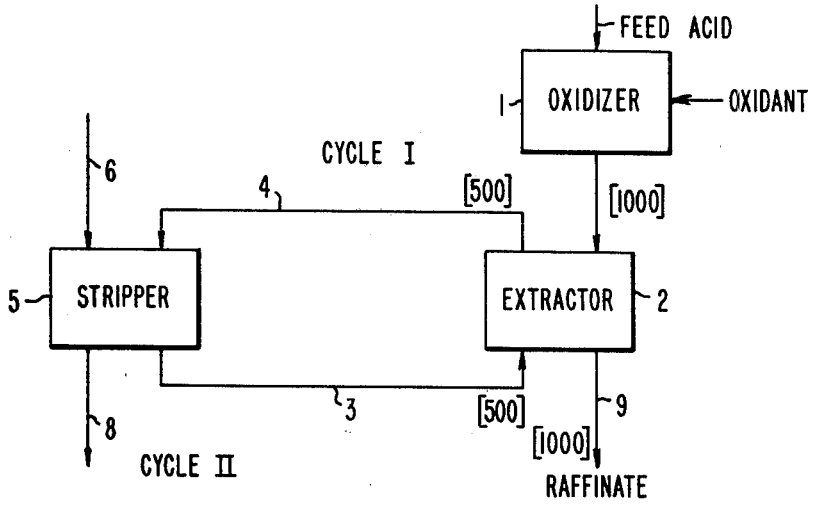
FIG. 1 shows a simplified flow diagram, illustrating a typical +6 uranium extraction process.

Referring now to FIG. 1 of the drawings, one method of extracting uranium from 30% $H_3PO_4$ is shown. Phosphoric feed acid is oxidized in oxidizer means 1, by one of many suitable oxidants well known in the art, such as, for example, a chlorate, permanganate, or chromate containing material among many others. In some instances, after oxidation, well known organic additives having a mild oxidant deactivation effect may be added to the oxidized feed acid, to control the formation of noxious and chemically destructive oxidation reaction product ions, and to fine tune and control the degree of oxidation to an acceptable value. When the addition of oxidant to the feed acid is described herein, it is to be understood that such mild oxidant deactivation control, may also be required, especially when very strong oxidants are used.

The oxidized acid, containing uranium and iron, primarily in the +6 and +3 valence state respectively, enters extraction means 2, which may contain 1 to 5 stages. This oxidized feed is typically a 35° C. to 50° C. aqueous, 5 M to 6 M solution of phosphoric acid having a pH of up to about 1.5. In some instances, oxidation may be carried out directly in the extractor. Generally, the phosphoric acid will be oxidized from an oxidation potential of about 300 mV. at 40° C. to from 350 mV. to 1,050 mV. at 40° C. Where oxidation to over about 700 mV. occurs an oxidant deactivator may be used to drop the value into the control range.

In the extraction means 2, the oxidized feed acid is mix contacted with a water-immiscible, organic extractant solvent composition from line 3. The extractant solvent composition comprises a reagent, generally dissolved in a hydrocarbon diluent such as kerosine. The reagent extracts the +6 uranium ions to form a uranium complex soluble in the organic solvent. The solvent composition from line 3 can contain, for example, about 0.2 to 0.7 of a dialkyl phosphoric acid having from 4 to 12 carbon atoms in each chain, preferably di(2-ethylhexyl) phosphoric acid (D2EHPA-reagent) per liter of diluent. Other solvents that could be used in different uranium extraction processes would include octyl phenyl phosphoric acid and octyl pyro phosphoric acid alone or in combination in kerosine, among others.

The solvent may also contain about 0.025 to about 0.25 mole of a synergistic reaction agent well known in the art, for example, a tri alkyl phosphine oxide, where the alkyl chains are linear, having from 4 to 10 carbon atoms, preferably tri octyl phosphine oxide (TOPO) per liter of solvent. These synergistic agents allow reduction of equipment size while increasing uranium extraction. The usual mole ratio of D2EHPA:TOPO is from about 3:1 to 5:1.

The hydrocarbon diluent is a liquid having a boiling point of over about 70° C. Preferably, the hydrocarbon will have a boiling point over about 125° C. The hydrocarbon must be essentially immiscible with the metal containing solution such as the hot phosphoric acid, and have a substantially zero extraction coefficient for the metal containing solution. The preferred hydrocarbons are refined, high boiling, high flash point, aliphatic or aliphatic-aromatic solvents. The most useful hydrocarbon is a product of distillation of petroleum having a boiling point of between about 150° C. and about 300° C., and can be, preferably, a refined kerosine. The extractant solvent composition must contain from about 50 vol.% to about 90 vol.% hydrocarbon solvent diluent and about 10 vol.% to about 50 vol.% metal extractant reagent. These uranium extractant solvent compositions are standard, and well known in the art.

The pregnant solvent composition, containing complexed uranium and contaminates, passes through line 4 to reducing stripper means 5, to strip uranium from the organic solvent with strip acid from line 6. The reductive strip solution consists of an effective concentration of $Fe^{+2}$ ions dissolved in at least 5 to 7 molar phosphoric acid solution. The barren organic solvent leaving the stripper is then recycled through line 3 to the extractor 2, and the product acid is fed through line 8 to the second cycle of the process. The raffinate exits the extraction means through line 9. The raffinate will contain iron and fluorine in aqueous phosphoric acid.

We have found that the state of oxidation of the uranium in the pregnant solvent stream 4, can be determined by measuring the oxidation potential of the raffinate acid in stream 9, which is in part controlled by the relative amount of $Fe^{+2}$ to $Fe^{+3}$. We have also found that maximum uranium extraction coefficients, i.e., E°=uranium in the organic phase/uranium in the aqueous phase, are achieved at iron ions containing raffinate acid oxidation potentials of between 350 mV. to about 700 mV., preferably at between about 360 mV., to about 460 mV. Calculation of the E° values are well known in the art. An E° value below about 1.0 would indicate that commercial uranium recovery would be uneconomical.

Figure 2:
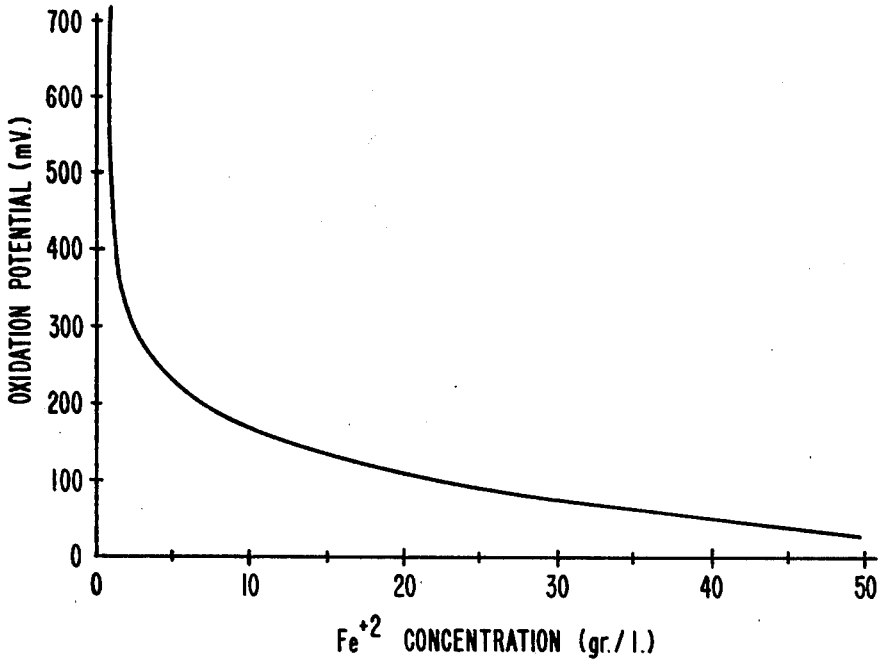
FIG. 2 shows a graph of oxidation potential vs. $Fe^{+2}$ concentration in phosphoric acid.
Figure 3:
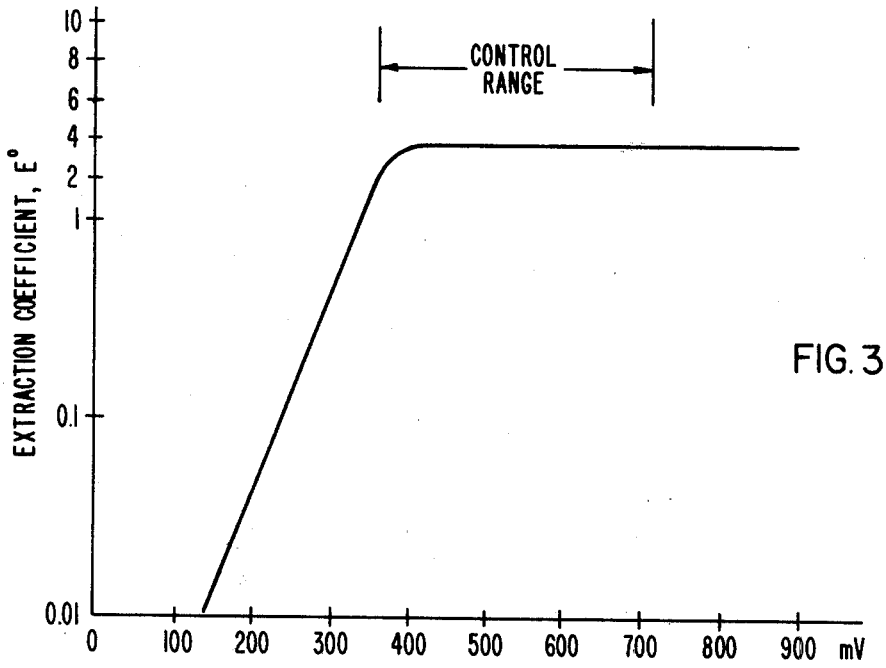
FIG. 3 shows a graph of maximum uranium extraction coefficient vs. oxidation potential in phosphoric acid.
Figure 4:
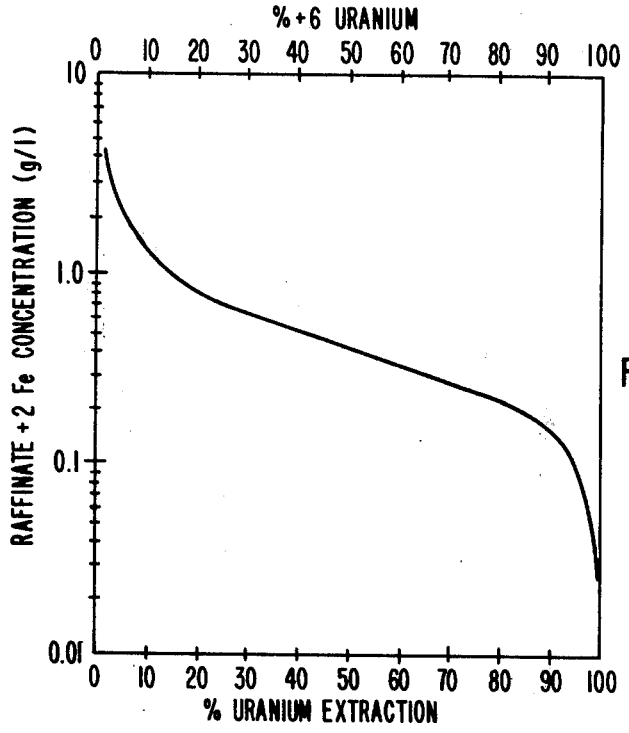
FIG. 4 shows a graph of % uranium extraction vs. $Fe^{+2}$ concentration in the raffinate stream.

The raffinate acid oxidation potential in stream 9 indicates the status of $Fe^{+2} \rightarrow Fe^{+3}$, which is directly related to $U^{+4} \rightarrow U^{+6}$ in the pregnant solvent stream 4. FIG. 2 illustrates the relation of phosphoric acid oxidation potential to +2 iron concentration in phosphoric acid. After the phosphoric acid is oxidized, high extraction of +6 uranium is possible at raffinate oxidation potentials between 350 mV. and about 700 mV. and E° values of between 1.0 to about 5, as shown in FIG. 3. FIG. 4 shows the delicacy of the $U^{+4}$ to $U^{+6}$ balance in relation to $Fe^{+2}$ concentration. In FIG. 4, the % uranium extraction drops to about 15% when the $Fe^{+2}$ concentration rises to 1 gram/liter. At a $Fe^{+2}$ concentration of 0.1 gram/liter about 95% of the uranium is capable of being extracted.

Most oxidants oxidize wet phosphoric acid to between about 300 mV. and 1,050 mV. As can be seen from FIGS. 2 and 3, values between 300 mV. and 350 mV. will not maximize +6 uranium extraction, and values over about 750 mV. provide excess oxidant in the system, which could cause a variety of corrosion and process problems and adds unnecessary cost.

Generally, the wet process phosphoric acid is continuously oxidized, either in a separate oxidizer or in the extractor, with a steady quantity of oxidant. However, the barren solvent stream 3 may recycle a large amount of $Fe^{+2}$ into the extractor. An excess amount of $Fe^{+2}$ in the extractor is one of the main causes responsible for upsetting the delicate $U^{+4} \rightarrow U^{+6}$ equilibrium, and dropping the uranium extraction coefficient below 1.0, the minimum point of efficient commercial uranium extraction. A control is necessary to recognize and counteract this possibility.

Measuring the E° value is relatively time consuming and would not provide the type of control necessary in commercial plant operation. An almost instantaneous control is possible by measuring the oxidation potential of the raffinate. This raffinate mV. control, if a drop below 350 mV. were observed, would signal that the entire system should be checked for a variety of problems, and that, as one solution, an effective amount, about 10% to 30% of extra oxidant may have to be fed into the process, before the extractor or at the extractor, increasing oxidant concentration, to increase the oxidation potential and the uranium extraction coefficient. Another solution may be to decrease the amount of oxidant deactivator, if one is used, so that the oxidant concentration is increased. The stripper-settler should also be checked, to see if there has been proper phase disengagement; if not, a variety of methods could be used to correct the situation and restore the proper raffinate mV. value.

The raffinate acid oxidation potential measurement, which in fact measures the ratio of $Fe^{+2}$ to $Fe^{+3}$, provides effective process control to assure high uranium extraction. General controlling rules are that if the oxidation potential of the iron ion containing raffinate is above about 700 mV., excess oxidant is being added to the process. If the oxidation potential of the iron ion containing raffinate is below 350 mV., usually, either the feed acid was not totally oxidized, or reduced $Fe^{+2}$ containing acid from the strip section is entrained with the barren solvent being fed into the extractor. In either case, quick corrective action of the process deviation will permit low reactant consumption with high uranium recovery. Maintaining the oxidation potential of the raffinate acid stream at a value above 350 mV., by any variety of effective means, such as adding more oxidant to the feed acid, will effectively control the process.

EXAMPLE 1

Referring to FIG. 1 of the drawings, commercial grade, wet process, purified, oxidized, 5.6 M aqueous phosphoric acid (30% $P_2O_5$, sp. gr.=1.36, oxidized from 350 mV. to between about 650 to 700 mV. and then dropped by use of an oxidant deactivator to a final oxidation potential value of approximately 450 mV.), containing about 0.2 gram/liter of uranium, about 10 grams/liter of iron and varying amounts of other metals and humic acid impurities, was fed at 35° C. into an extractor means in a pilot plant operation. In the extractor, it countercurrent mixed with a water-immiscible, organic, uranium extraction solvent composition, containing 0.5 mole of di-2-ethylhexyl phosphoric acid (D2EHPA) and 0.125 mole of tri-n-octylphosphine oxide per 1 liter of kerosine as solvent. The volume rates of feed phosphoric acid:solvent composition mixing in the extractor was about 1:0.5 gal/min.

Pregnant solvent composition, containing complexed uranium was then passed from the extractor to a reductive stripper, to strip uranium from the organic solvent and provide a barren, uranium extraction solvent stream, which was fed back to the extractor. The initial E° value of the pregnant solvent was calculated to be about 2.0. The strip solution containing uranium ions leaving the stripper, shown as line 8 in FIG. 1, was then fed into cycle II. Raffinate acid, containing iron ions, passed from the extractor to be further processed. The volume rates of pregnant solvent:barren solvent:raffinate were about 0.5:0.5:1 gal/min.

The oxidation potential of samples of the raffinate was periodically measured, using an Orion 601 digital multimeter with a calomel/platinum probe. After more than 48 hours of continuous operation the oxidation potential of the raffinate dropped from an initial value of approximately 450 mV. to about 320 mV. At this time, the E° value of the pregnant solvent was calculated to be about 0.5. During continuous operation, $Fe^{+2}$ from the barren solvent was believed to have affected the $U^{+4}$ to $U^{+6}$ equilibrium in the extractor. This $Fe^{+2}$ ion concentration build-up was believed to be mainly responsible for the fall in the oxidation potential of the raffinate.

Thus alerted, by the mV. value dropping below 350 mV., as an initial response, the mild oxidant deactivator addition to the wet process feed acid was decreased 15% so as to increase the oxidant concentration. After about 2.5 hours, the oxidation potential of the raffinate again read approximately 400 mV. with a corresponding E° value of about 2 calculated on the pregnant solvent. Thus, monitoring the oxidation potential of the iron containing raffinate acted as a control, allowing quick response to a drop in uranium extraction coefficient in the process, and providing time to find the cause of the problem while continuing process operation. An equally suitable response, to maintain the oxidation potential of the raffinate acid stream at a value above 350 mV., would have been to increase the oxidant concentration by adding about 10% more oxidant.

We claim:

1. In the method of recovering uranium from wet process phosphoric acid containing uranium and iron ions, wherein wet process phosphoric acid feed solution is oxidized, passed through an extraction means to provide a uranium rich solvent stream and a raffinate acid stream containing iron ions, and wherein the uranium rich solvent stream is passed through a reductive stripping means, the improvement comprising measuring the oxidation potential of the raffinate acid stream after wet process acid feed extraction and maintaining the oxidation potential of the raffinate acid stream if it deviates from a value between 350 mV. and about 700 mV. by changing the amount of oxidation of the acid feed solution.

2. A method of controlling the uranium extraction coefficient in the process of uranium extraction from phosphoric acid, comprising the steps of:

(1) continuously contacting a wet process phosphoric acid feed solution, containing $U^{+4}$ ions and $Fe^{+2}$ ions, and having an oxidation potential of below 350 mV., with an oxidant in an amount effective to raise the oxidation potential of the phosphoric acid solution to a value above 350 mV. and convert $U^{+4}$ ions and $Fe^{+2}$ ions to $U^{+6}$ ions and $Fe^{+3}$ ions respectively, and contacting the oxidized phosphoric acid solution in an extraction means with a uranium extraction solvent composition, to provide a uranium rich solvent stream, and a raffinate acid stream containing iron ions;

(2) reductively stripping the uranium rich solvent stream of uranium in a stripping means, to provide a uranium rich product stream and a uranium extraction solvent composition stream containing minor amounts of reduced iron in the form of $Fe^{+2}$ ions;

(3) feeding the uranium extraction solvent composition stream back into the extraction means, to contact oxidized phosphoric acid solution containing $U^{+6}$ ions and $Fe^{+3}$ ions, to provide additional uranium rich solvent and iron ion rich raffinate, where the $Fe^{+2}$ ions in the extraction solvent composition can affect the valence of the $U^{+6}$ ions and cause the uranium extraction coefficient of the uranium rich solvent stream to drop;

(4) measuring the oxidation potential of the raffinate acid stream after wet process feed acid extraction; and (5) when the oxidation potential of the raffinate acid stream drops to a value below 350 mV., increasing the concentration of the oxidant in step (1) in an amount effective to raise the oxidation potential of the raffinate acid stream to a value above 350 mV.

3. The method of claim 2, wherein the uranium extractant solvent composition comprises dialkyl phosphoric acid, trialkyl phosphine oxide and hydrocarbon diluent.

4. The method of claim 2, wherein the uranium extractant solvent composition comprises di(2-ethylhexyl) phosphoric acid, trioctyl phosphine oxide and hydrocarbon diluent.

5. The method of claim 2, wherein the oxidant is added directly to the phosphoric acid feed in the extraction means.

6. The method of claim 2, wherein the oxidant raises the oxidation potential of the phosphoric acid solution in steps (1) and (5) to a value of between 350 mV. and about 700 mV., and the uranium rich solvent stream has a uranium extraction coefficient value of over 1.0.

7. The method of claim 1, wherein the acid feed has an oxidation potential value above 350 mV. after oxidation, and the uranium rich solvent stream has a uranium extraction coefficient value of over about 1.0.

* * * * *